US010854403B2

(12) United States Patent
Takai

(10) Patent No.: US 10,854,403 B2
(45) Date of Patent: Dec. 1, 2020

(54) VACUUM INTERRUPTER AND VACUUM CIRCUIT BREAKER USING SAME

(71) Applicant: Mitsubishi Electric Corporation, Tokyo (JP)

(72) Inventor: Yuichi Takai, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/479,047

(22) PCT Filed: Oct. 25, 2017

(86) PCT No.: PCT/JP2017/038484

§ 371 (c)(1),
(2) Date: Jul. 18, 2019

(87) PCT Pub. No.: WO2018/189939

PCT Pub. Date: Oct. 18, 2018

(65) Prior Publication Data

US 2020/0043686 A1 Feb. 6, 2020

(30) Foreign Application Priority Data

Apr. 11, 2017 (JP) ..... 2017-078040

(51) Int. Cl.
*H01H 33/66* (2006.01)
*H01H 33/662* (2006.01)

(52) U.S. Cl.
CPC ..... *H01H 33/66261* (2013.01); *H01H 33/66207* (2013.01); *H01H 2033/66276* (2013.01)

(58) Field of Classification Search
CPC ..... H01H 33/66261; H01H 33/66207; H01H 2033/66276; H01H 33/662
See application file for complete search history.

(56) References Cited

U.S. PATENT DOCUMENTS 3,048,681 A * 8/1962 Polinko, Jr. ..... H01H 33/66261 218/137
3,766,345 A * 10/1973 Attia ..... H01H 33/66261 218/136

(Continued)

FOREIGN PATENT DOCUMENTS

GB 2341979 A 3/2000
JP S58169833 A 10/1983

(Continued)

OTHER PUBLICATIONS

International Search Report (PCT/ISA/210) with translation, and Written Opinion (PCT/ISA/237) dated Dec. 26, 2017, by the Japan Patent Office as the International Searching Authority for International Application No. PCT/JP2017/038484.

*Primary Examiner* — Truc T Nguyen
(74) *Attorney, Agent, or Firm* — Buchanan Ingersoll & Rooney PC

(57) ABSTRACT

A vacuum interrupter according to the present invention includes: a vacuum container formed by two insulation containers each having an opening at one end thereof, the openings being opposed to each other; a pair of electrodes provided inside the vacuum container; and an arc shield having a contamination preventing portion surrounding the electrodes, and projections projecting in a direction along an outer circumferential surface of the contamination preventing portion, the arc shield being positioned by the projections being engaged with the openings.

13 Claims, 12 Drawing Sheets

(56) References Cited

U.S. PATENT DOCUMENTS 4,002,867 A * 1/1977 Cherry ..... H01H 33/66261 218/134
4,135,071 A * 1/1979 Crouch ..... H01H 1/0203 200/275
4,361,742 A * 11/1982 Kashiwagi ..... H01H 33/66261 218/136
4,394,554 A * 7/1983 Warabi ..... H01H 33/66207 218/134
4,440,995 A * 4/1984 Lange ..... H01H 33/668 218/122
4,471,184 A * 9/1984 Sano ..... H01H 1/0203 218/127
4,471,309 A * 9/1984 Lange ..... G01L 21/34 324/424
4,661,665 A * 4/1987 Carroll ..... H01H 33/6641 218/141
4,757,166 A * 7/1988 Slade ..... H01H 33/66207 218/134
5,399,973 A * 3/1995 Kitamura ..... H01H 33/668 324/424
5,438,174 A * 8/1995 Slade ..... H01H 33/6644 218/118
6,255,615 B1 * 7/2001 Kimblin ..... H01H 31/003 218/155
2012/0168291 A1 * 7/2012 Reuber ..... H01H 33/66261 200/302.2
2013/0120879 A1 * 5/2013 Shea ..... H02H 3/00 361/13
2016/0141119 A1 * 5/2016 Li ..... H01H 11/04 218/118

FOREIGN PATENT DOCUMENTS

JP S58204432 A 11/1983
JP 2003317583 A 11/2003

* cited by examiner

VACUUM INTERRUPTER AND VACUUM CIRCUIT BREAKER USING SAME

TECHNICAL FIELD

The present invention relates to a vacuum interrupter used for a vacuum circuit breaker or the like.

BACKGROUND ART

In general, a vacuum interrupter has a structure in which electrodes for performing conduction and interruption of current are provided so as to be opposed to each other in a vacuum container composed of two insulation containers. The two insulation containers composing the vacuum container are made from an insulation material such as a glass material or a ceramic material. A fixed-side end plate is attached to an end of one of the insulation containers, a movable-side end plate is attached to an end of the other insulation container, and both insulation containers are joined with their openings opposed to each other, to form the vacuum container. A fixed-side electrode rod penetrates through the fixed-side end plate and is fixed thereto, and a movable-side electrode rod penetrates through the movable-side end plate and is fixed thereto. A fixed-side electrode and a movable-side electrode are attached to respective ends of the fixed-side electrode rod and the movable-side electrode rod so as to be opposed to each other.

A bellows formed by processing a thin metal plate such as stainless steel in a bellows shape is attached around the movable-side electrode rod. One end of the bellows is joined to the movable-side end plate and the other end is joined to the movable-side electrode rod. The part where the bellows and the movable-side electrode rod are joined to each other is covered with a bellows cover. Providing the bellows and the bellows cover enables the inside of the vacuum container to be maintained in an airtight state even under operation of the movable-side electrode rod.

An arc shield is provided around the movable-side electrode and the fixed-side electrode in the vacuum container, and a contamination preventing portion of the arc shield surrounds the electrodes, thereby preventing the inner surface of the vacuum container from being contaminated due to occurrence of an arc when the electrodes are opened or closed. The vacuum container forming the vacuum interrupter is formed such that the two insulation containers on the fixed side and the movable side are joined to each other with their openings opposed to each other as described above, and a part of the arc shield is held between the joined parts so as to be fixed.

CITATION LIST

Patent Document

Patent Document 1: Japanese Laid-Open Patent Publication No. 58-169833

Patent Document 2: Japanese Laid-Open Patent Publication No. 58-204432

Patent Document 3: Japanese Laid-Open Patent Publication No. 2003-317583

SUMMARY OF THE INVENTION

Problems to be Solved by the Invention

In order to ensure stable interruption performance and withstand voltage performance of the vacuum interrupter, it is necessary to prevent positional deviation of the contamination preventing portion of the arc shield provided around the electrodes in the vacuum container. When positional deviation of the arc shield occurs and the contamination preventing portion of the arc shield becomes eccentric from the axis of the vacuum interrupter, the electric field value increases at a part where the spatial distance between the contamination preventing portion of the arc shield, and the movable-side electrode and the fixed-side electrode, is shortened. Thus, interruption performance and withstand voltage performance are locally reduced. In a general vacuum interrupter, openings of two insulation containers are opposed to each other so as to hold an arc shield therebetween, thereby fixing the arc shield. At this time, it is necessary to use a jig for arranging them at accurate positions, and thus the working time is prolonged and the process is complicated. Meanwhile, for the purpose of simplification, in the case of performing positioning through visual observation without using a jig or the like, withstand voltage performance might become insufficient.

Reduction in withstand voltage performance can be caused due to minute protrusions on the surfaces of the movable-side electrode, the fixed-side electrode, and the arc shield. After the vacuum container and the like are brazed, in order to remove the minute projections, voltage may be applied to the movable-side electrode or the fixed-side electrode, thereby performing minute projection removal called voltage conditioning. However, in some cases, the arc shield is grounded during voltage conditioning. Therefore, in the case where a flange portion of the arc shield protruding from the insulation container has a narrow width, a complicated jig is needed for connecting a grounding wire, thus causing a problem of prolonging the working time.

The present invention has been made to solve the above problem, and an object of the present invention is to obtain a vacuum interrupter that facilitates positioning of an arc shield provided inside the vacuum interrupter and achieves simplification of an assembly process and shortening of the working time.

Another object of the present invention is to obtain a vacuum interrupter that facilitates connection of a grounding wire to an arc shield in voltage conditioning for removing minute projections of electrodes and the like, thereby shortening a time required for the voltage conditioning.

Solution to the Problems

A vacuum interrupter according to the present invention includes: a vacuum container formed by two insulation containers each having an opening at one end thereof, the openings being opposed to each other; a pair of electrodes provided inside the vacuum container; and an arc shield having a contamination preventing portion surrounding the electrodes, and projections projecting in a direction along an outer circumferential surface of the contamination preventing portion, the arc shield being positioned by the projections being engaged with the openings.

Effect of the Invention

In the vacuum interrupter according to the present invention, the projections formed at the flange portion of the arc shield are engaged with the openings of the insulation containers, so as to position the arc shield, whereby the arc shield and the vacuum container composed of the two insulation containers can be accurately arranged and combined. Therefore, the contamination preventing portion of the arc shield can be prevented from becoming eccentric from the axis of the vacuum interrupter, whereby interruption performance and withstand voltage performance can be stabilized. In addition, since the arc shield itself has a positioning function, an assembly jig is not needed and thus the working time is shortened. Further, since the protrusion pieces of the flange portion of the arc shield protrude from the outer circumferential surface of the insulation container, it is possible to easily connect a grounding wire to the arc shield by a clip or the like at the time of voltage conditioning for removing minute projections of the electrodes and the like. Therefore, a jig for connecting the grounding wire is not needed and the working time can be shortened.

DESCRIPTION OF EMBODIMENTS

Figure 1:
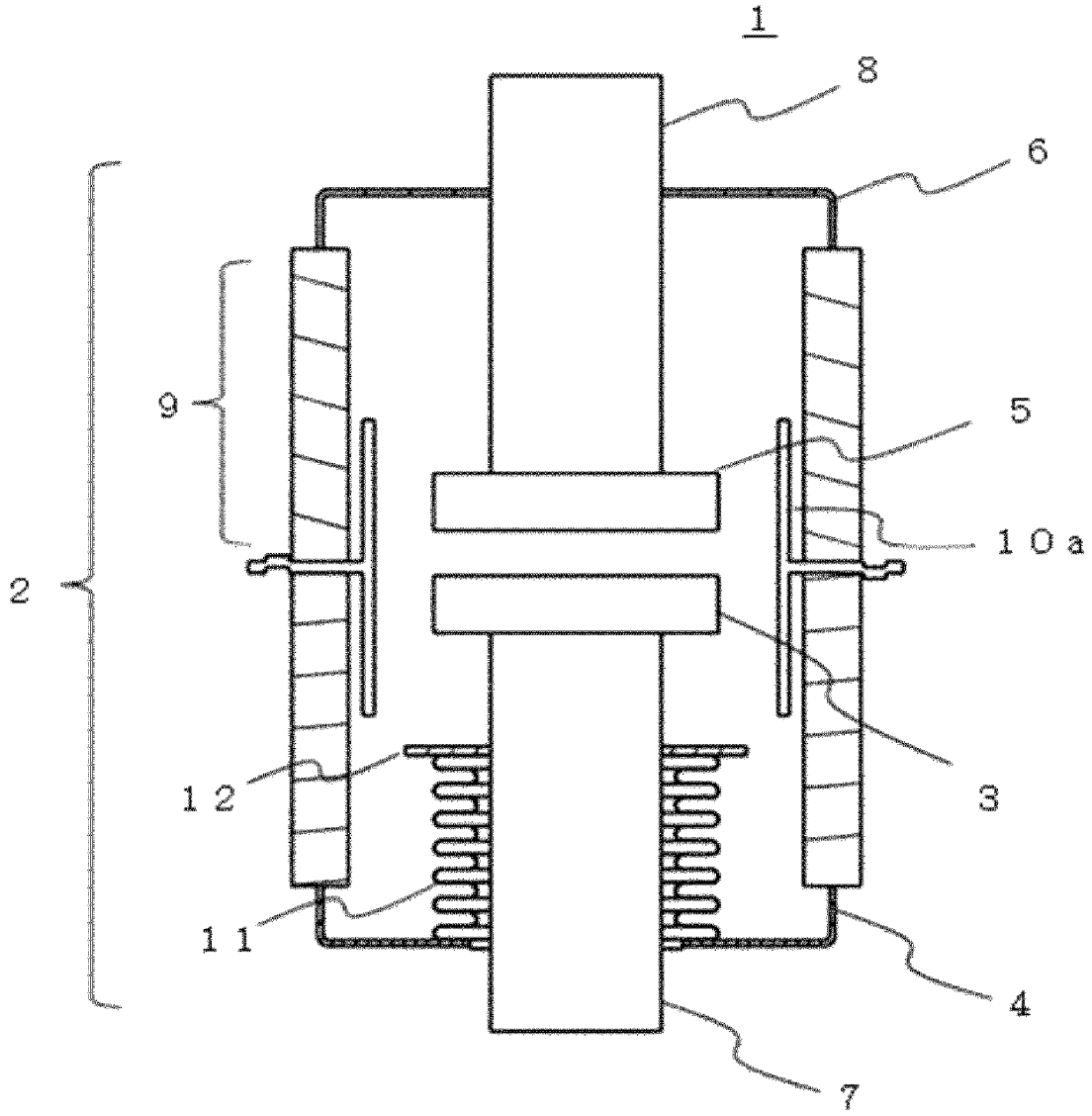
FIG. 1 is a sectional view of a vacuum interrupter according to embodiment 1 of the present invention.

In description of embodiments and the drawings, the same or corresponding parts are denoted by the same reference characters.

Embodiment 1

Figure 2:
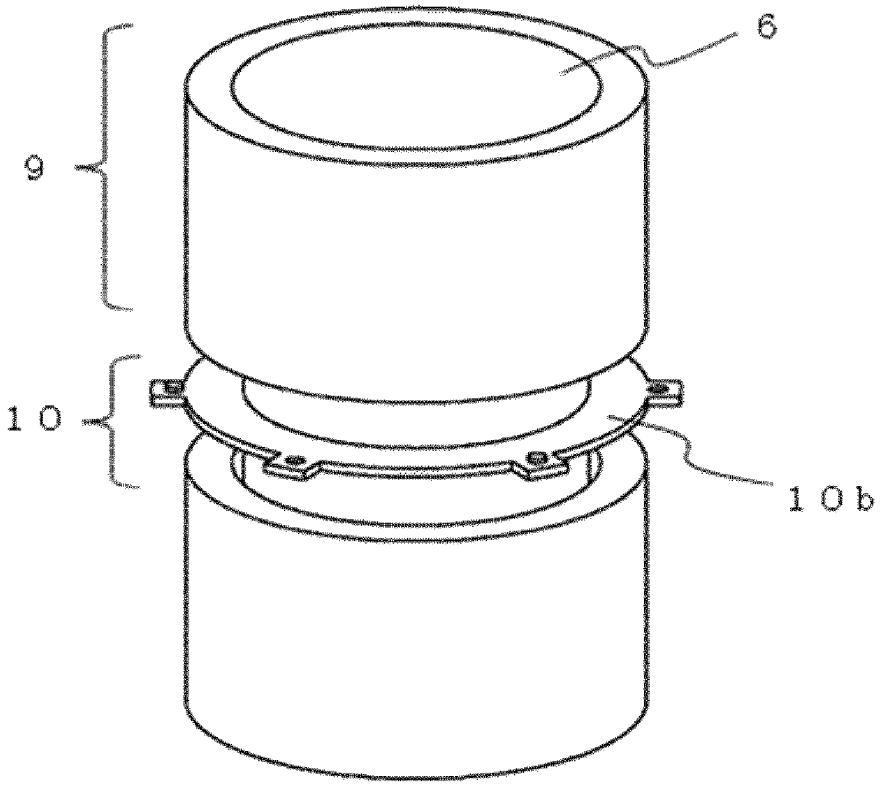
FIG. 2 is an assembly view of insulation containers and an arc shield according to embodiment 1 of the present invention.
Figure 3:
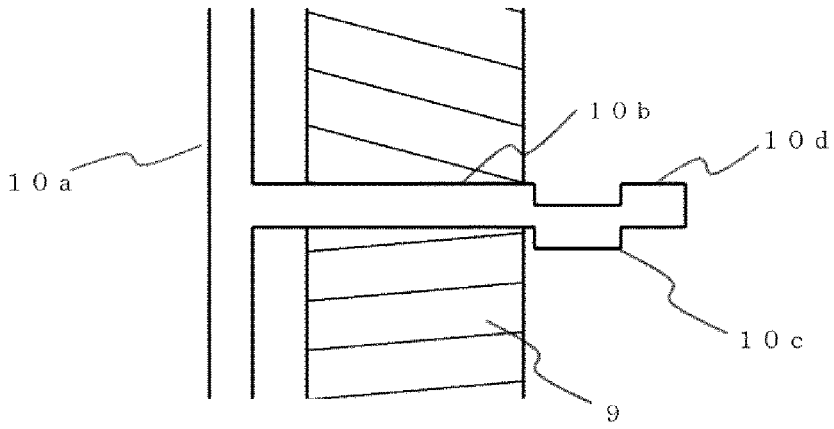
FIG. 3 is an enlarged sectional view of an embossed-shape projection of the arc shield according to embodiment 1 of the present invention.
Figure 4:
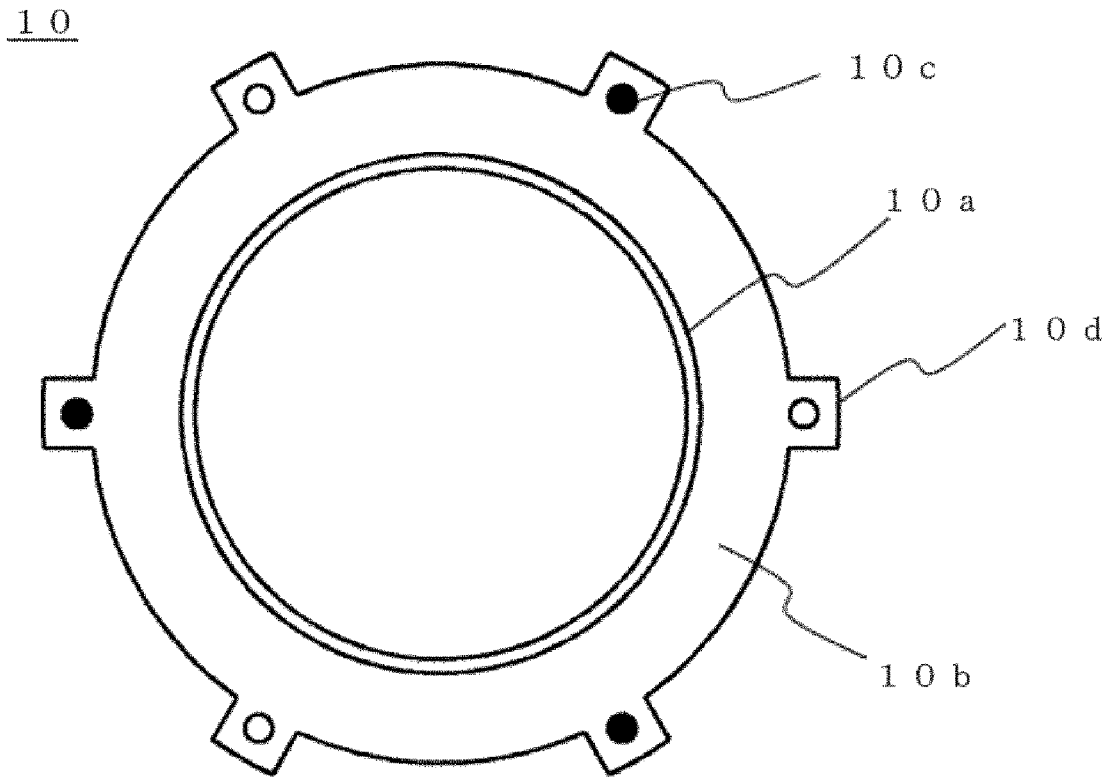
FIG. 4 is a plan view of the arc shield according to embodiment 1 of the present invention.

With reference to FIGS. 1 to 4, the structure of a vacuum interrupter according to the present embodiment will be described. FIG. 1 shows a sectional view of a vacuum interrupter 1 according to the present embodiment. FIG. 2 shows assembling of insulation containers 9 and an arc shield 10 of the vacuum interrupter 1 according to the present embodiment. In FIG. 2, a movable-side electrode rod 7 and a fixed-side electrode rod 8 are not shown, for simplification. FIG. 3 shows an enlarged sectional view of a flange portion 10*b* formed around the outer circumferential surface of a contamination preventing portion 10*a* of the arc shield 10, and a protrusion piece 10*d* having an embossed-shape projection 10*c* formed on the flange portion 10*b*, and shows a state in which the protrusion piece 10*d* of the arc shield 10 is retained and fixed at the openings of the insulation containers 9. FIG. 4 shows a plan view of the arc shield 10, and shows the contamination preventing portion 10*a* of the arc shield 10, the flange portion 10*b* formed around the outer circumferential surface thereof, the protrusion pieces 10*d* formed on the flange portion 10*b*, and the embossed-shape projections 10*c*. It is noted that, in FIG. 4, the embossed-shape projections 10*c* are expressed as "○" and "•". The part "○" projects frontward of the drawing, and the part "•" projects backward of the drawing. In other words, these indicate projections upward/downward with respect to the protrusion piece 10*d*.

As shown in FIG. 1, the vacuum interrupter 1 is configured such that the vacuum container 2 surrounds the outer circumferential part and electrodes for performing conduction and interruption of current are provided so as to be opposed to each other inside the vacuum container 2. The vacuum container 2 is composed of two insulation containers 9 made from an insulation material, and has a fixed-side end plate 6 at an end of one insulation container 9 and a movable-side end plate 4 at an end of the other insulation container 9. Further, a fixed-side electrode rod 8 penetrates through the fixed-side end plate 6 and is fixed thereto, and a movable-side electrode rod 7 penetrates through the movable-side end plate 4 and is retained thereto.

A fixed-side electrode 5 and a movable-side electrode 3 are respectively attached to the fixed-side electrode rod 8 and the movable-side electrode rod 7 so as to be opposed to each other. A bellows 11 and a bellows cover 12 are attached to the movable-side electrode rod 7, and maintain the inside of the vacuum container 2 in an airtight state while operating correspondingly to movement of the movable-side electrode rod 7 during open/close operation of the electrodes.

As shown in FIG. 1, the contamination preventing portion 10*a* of the arc shield 10 is provided around the movable-side electrode 3 and the fixed-side electrode 5 which are located at the center part of the vacuum interrupter 1.

The contamination preventing portion 10*a* of the arc shield 10 is provided so as to surround the contact parts of the electrodes, thereby suppressing contamination of the surroundings due to an arc occurring at the time of interruption operation of the movable-side electrode 3 and the fixed-side electrode 5.

As shown in the sectional view of the vacuum interrupter 1 in FIG. 1, the assembly view in FIG. 2, and the like, the arc shield 10 has the disk-shaped flange portion 10*b* extending radially outward from the outer circumferential surface of the contamination preventing portion 10*a* surrounding the movable-side electrode 3 and the fixed-side electrode 5 opposed to each other. As shown in FIG. 2 and FIG. 3, the flange portion 10*b* is held between the opposed openings of the two insulation containers 9 and thus is fixed at a predetermined position of the vacuum container 2. As shown in the plan view of the arc shield 10 in FIG. 4, a plurality of protrusion pieces 10*d* are provided around the flange portion 10*b* of the arc shield 10. The protrusion pieces 10*d* have the embossed-shape projections 10*c* which project upward (shown by "○") or downward (shown by "•") with respect to the protrusion pieces 10*d*, in the axial direction of the vacuum container, when the arc shield 10 is attached to the vacuum container 2 as shown in FIG. 1 and FIG. 2 to form the vacuum interrupter 1.

The state in which the arc shield 10 is fixed by being held between the openings of the insulation containers 9 is shown in the enlarged sectional view in FIG. 3. The plurality of protrusion pieces 10*d* are formed radially outward around the flange portion 10*b* of the arc shield 10, and as shown in FIG. 4, the protrusion pieces 10*d* have the embossed-shape projections 10*c* which project upward/downward of the protrusion pieces 10*d*. The embossed-shape projections 10*c* formed on the protrusion pieces 10*d* are engaged with the openings of the insulation containers 9, thereby positioning and fixing the arc shield.

When the arc shield 10 is mounted such that the embossed-shape projections 10*c* formed on the protrusion pieces 10*d* of the arc shield 10 are engaged with the openings of the insulation containers 9, the contamination preventing portion 10*a* of the arc shield 10 is located concentrically with the wall surface of the vacuum container 2, and thus the contamination preventing portion 10*a* can be prevented from becoming eccentric from the axis of the vacuum interrupter 1. As a result, there is no part where the distance between the contamination preventing portion 10*a* of the arc shield 10, and the movable-side electrode 3 and the fixed-side electrode 5, is shortened, and thus interruption performance and withstand voltage performance are stabilized.

Regarding positioning between the arc shield 10 and the insulation containers 9, the embossed-shape projections 10*c* formed on the protrusion pieces 10*d* of the arc shield 10 have a positioning function. Therefore, an assembly jig for positioning is not needed and the working time can be shortened. Further, since such unnecessary members are not used, the number of components can be decreased.

In the case where the protrusion pieces 10*d* still protrude outward from the outer circumferential surfaces of the insulation containers 9 in a state in which the arc shield 10 is fixed in the vacuum container 2, voltage conditioning for removing minute projections on the surfaces of the electrodes and the arc shield 10 is performed after the assembly process is completed by brazing of the vacuum interrupter 1. At this time, a grounding wire can be easily connected to the protrusion piece 10*d* by a clip or the like. Therefore, a specific jig or the like is not needed for connection of the grounding wire and the working time can be shortened.

After voltage conditioning, the vacuum interrupter 1 can be used in a state in which the protrusion pieces 10*d* are left as they are. However, leaving the protrusion pieces 10*d* might form an electric field vulnerable part which leads to insufficiency of withstand voltage performance, or when the vacuum interrupter 1 is incorporated into the vacuum circuit breaker, the left protrusion pieces 10*d* might interfere with peripheral equipment. If such a problem arises, the protrusion pieces 10*d* may be removed. In the case of removing the protrusion pieces 10*d* formed on the flange portion 10*b*, the plate thickness of the entire protrusion pieces 10*d* or cutting portions of the protrusion pieces 10*d* may be set to about 1 to 2 mm, so that they can be removed by being cut using a nipper or the like.

The contamination preventing portion 10*a* of the arc shield 10 has a cylindrical shape and is provided so as to surround the outer circumferences of the fixed-side electrode 5 and the movable-side electrode 3. Therefore, projections formed by cutting the protrusion pieces 10*d* present outside the contamination preventing portion 10*a* have very little influence on the electric field intensity inside the contamination preventing portion 10*a*, and thus it is considered that, basically, a specific process for relaxing the electric field is not needed. However, for example, in the case of interrupting very high voltage or in the case of providing a grounding part near the parts where the protrusion pieces 10*d* are cut, withstand voltage performance might become unsatisfactory due to minute projections formed on the edges of the parts where the protrusion pieces 10*d* are cut. In such a case, the parts where the protrusion pieces are cut and the edges thereof may be polished so as to remove such projections and smooth the surfaces thereof, whereby reduction in withstand voltage performance can be prevented. In addition, an electric field relaxing part (e.g., corona ring) made of metal or conductive resin may be attached on the outer circumferential side of the flange portion 10*b* of the arc shield 10 so as to cover the parts where the protrusion pieces are cut. Even in this case, reduction in withstand voltage performance can be prevented similarly.

In the present embodiment, the protrusion pieces 10*d* are formed around the flange portion 10*b* of the arc shield 10, the embossed-shape projections 10*c* are formed on the protrusion pieces 10*d*, and the embossed-shape projections 10*c* are engaged with the openings of the insulation containers 9, thereby positioning the arc shield 10. However, it is possible to obtain such a positioning effect similarly even in the case of forming embossed portions 10*c* directly on the flange portion 10*b* without using the protrusion pieces 10*d*.

Embodiment 2

Figure 5:
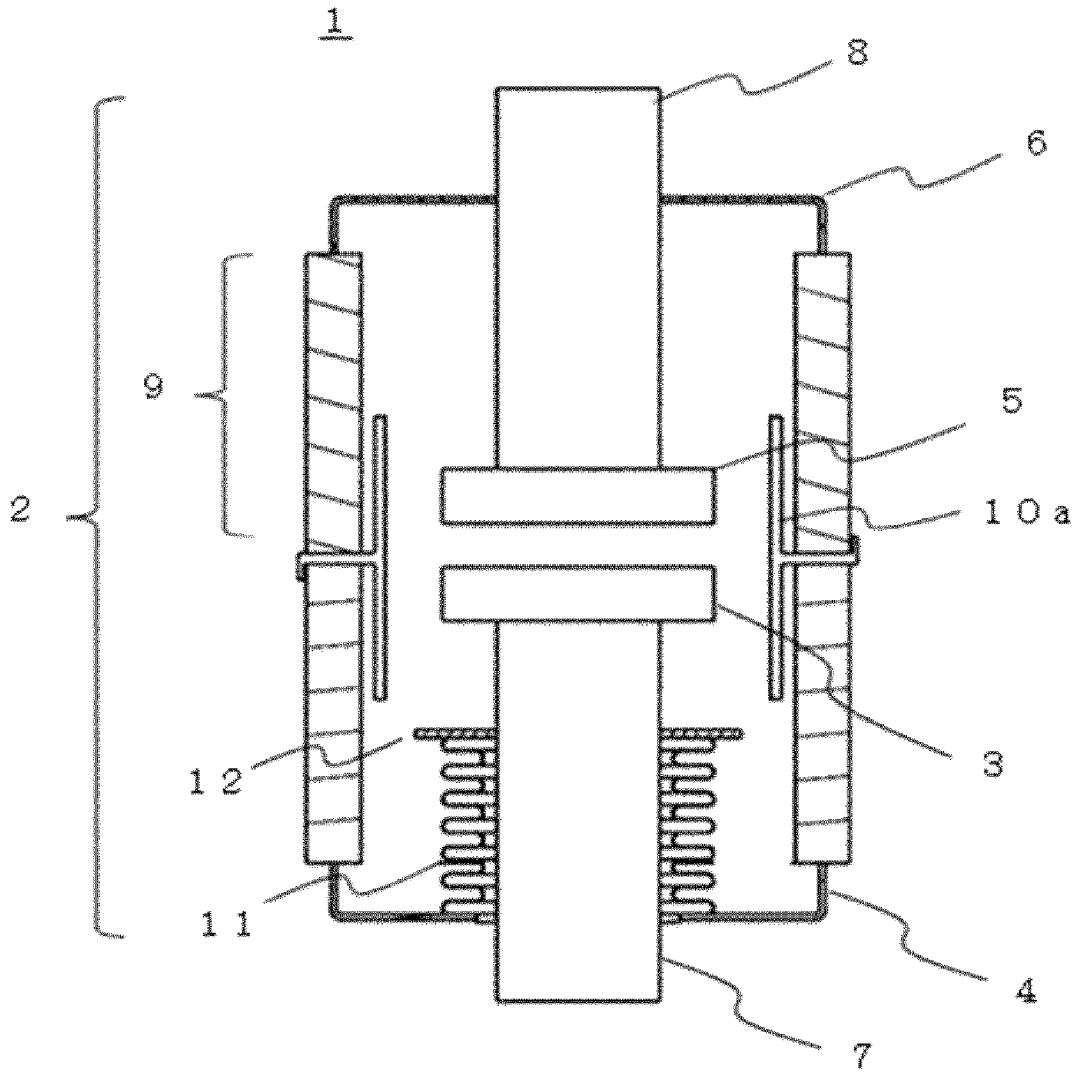
FIG. 5 is a sectional view of a vacuum interrupter according to embodiment 2 of the present invention.
Figure 6:
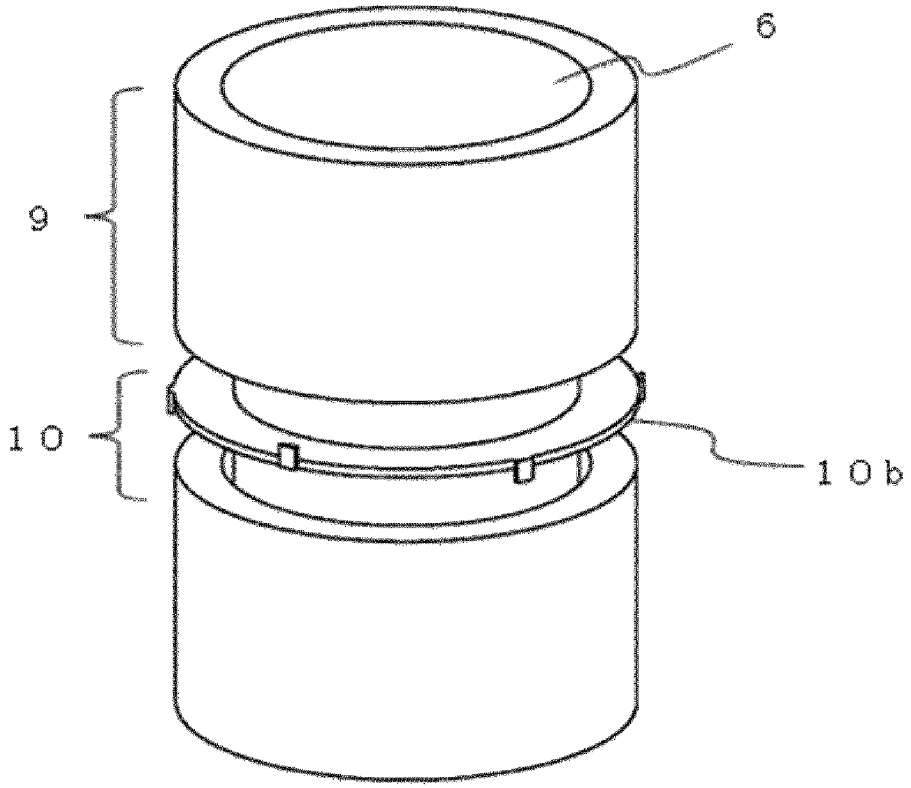
FIG. 6 is an assembly view of insulation containers and an arc shield according to embodiment 2 of the present invention.
Figure 7:
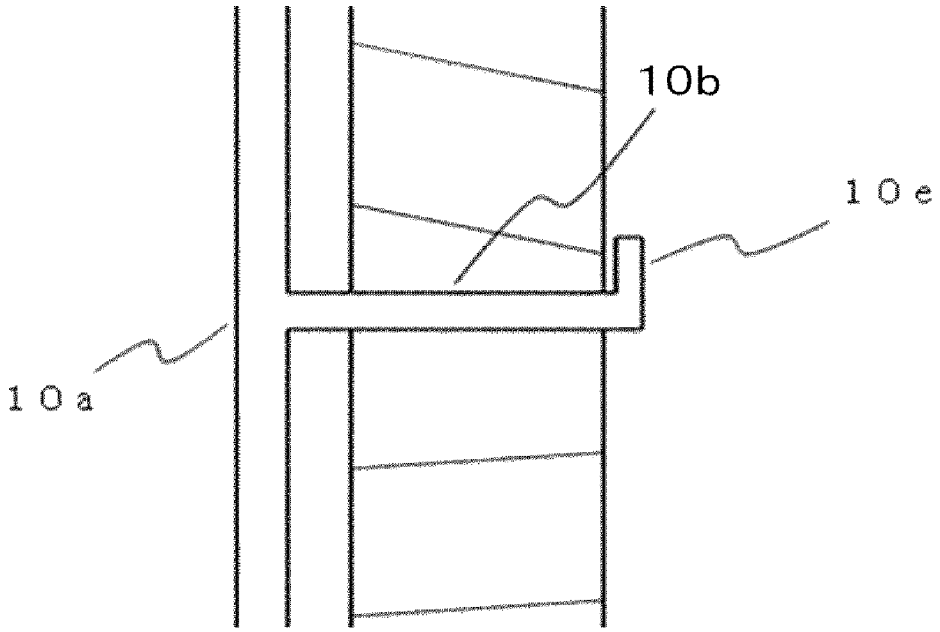
FIG. 7 is an enlarged sectional view of a bent-shape projection of the arc shield according to embodiment 2 of the present invention.
Figure 8:
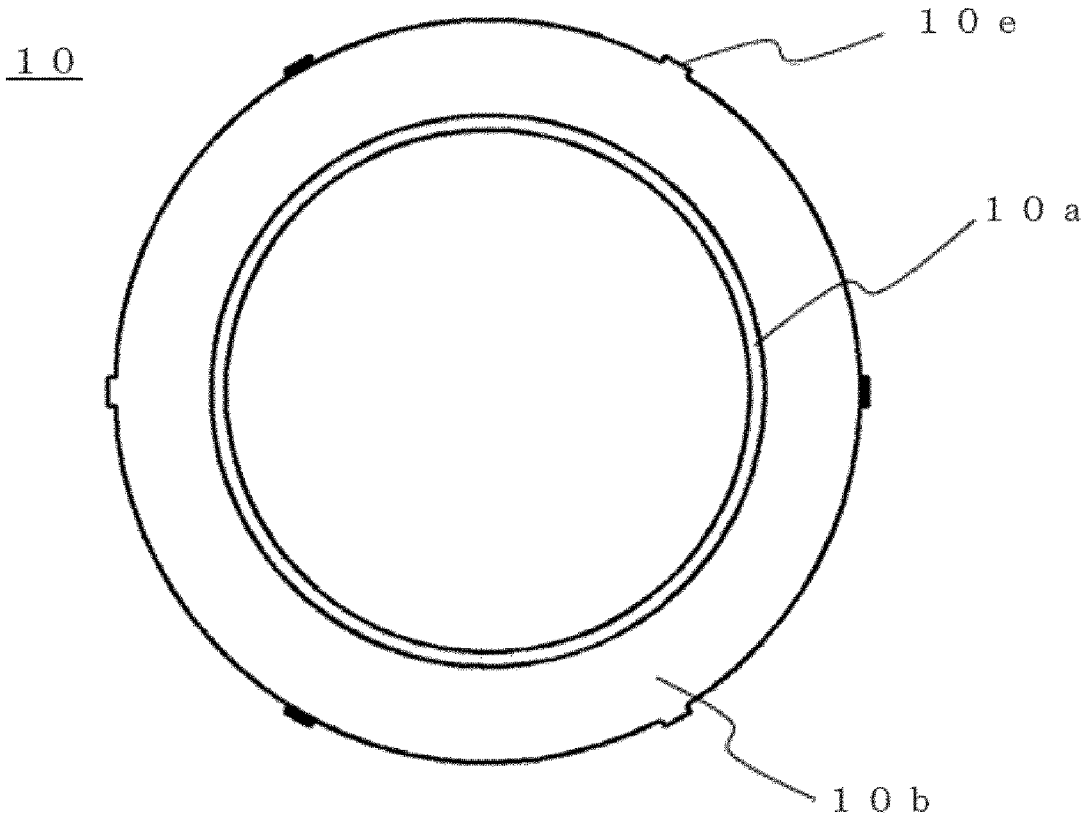
FIG. 8 is a plan view of the arc shield according to embodiment 2 of the present invention.

With reference to FIGS. 5 to 8, the structure of a vacuum interrupter 1 according to embodiment 2 of the present invention will be described. FIG. 5 is a sectional view of the vacuum interrupter 1 according to the present embodiment, and FIG. 6 shows assembling of insulation containers 9 and an arc shield 10 of the vacuum interrupter 1 according to the present embodiment. FIG. 7 shows an enlarged sectional view of a bent-shape projection 10*e* formed on a flange portion 10*b* of the arc shield 10. FIG. 8 shows a plan view of the arc shield 10 and shows the flange portion 10*b* formed on the arc shield 10 and the bent-shape projections 10*e* formed on the flange portion 10*b*.

In comparison between the vacuum interrupter 1 described in embodiment 1 and the vacuum interrupter 1 of the present embodiment, in embodiment 1, the embossed-shape projections 10*c* are formed on the protrusion pieces 10*d* of the arc shield 10. On the other hand, the present embodiment is different in that the bent-shape projections 10*e* each formed by bending a part of the flange portion 10*b* in the axial direction of the vacuum container 2 are provided around the flange portion 10*b* of the arc shield 10. The flange portion 10*b* of the arc shield 10 having the bent-shape projections 10*e* is fixed by being held between the openings of the two insulation containers 9. Thus, owing to the positioning effect by the bent-shape projections 10*e*, it is possible to prevent the contamination preventing portion 10*a* of the arc shield 10 from becoming eccentric from the axis of the vacuum interrupter 1. As a result, the spatial distance between the contamination preventing portion 10*a*, and the movable-side electrode 3 and the fixed-side electrode 5, is not shortened, and interruption performance and withstand voltage performance can be stabilized.

In the present embodiment, the bent-shape projections 10*e* are formed directly on the flange portion 10*b* of the arc shield 10, and the bent-shape projections 10*e* are engaged with the openings of the insulation containers 9, thereby positioning the arc shield 10. However, it is possible to obtain such a positioning effect similarly even in the case of forming the protrusion pieces 10*d* around the flange portion 10*b* and forming the bent-shape projections 10*e* on the protrusion pieces 10*d*.

Embodiment 3

Figure 9:
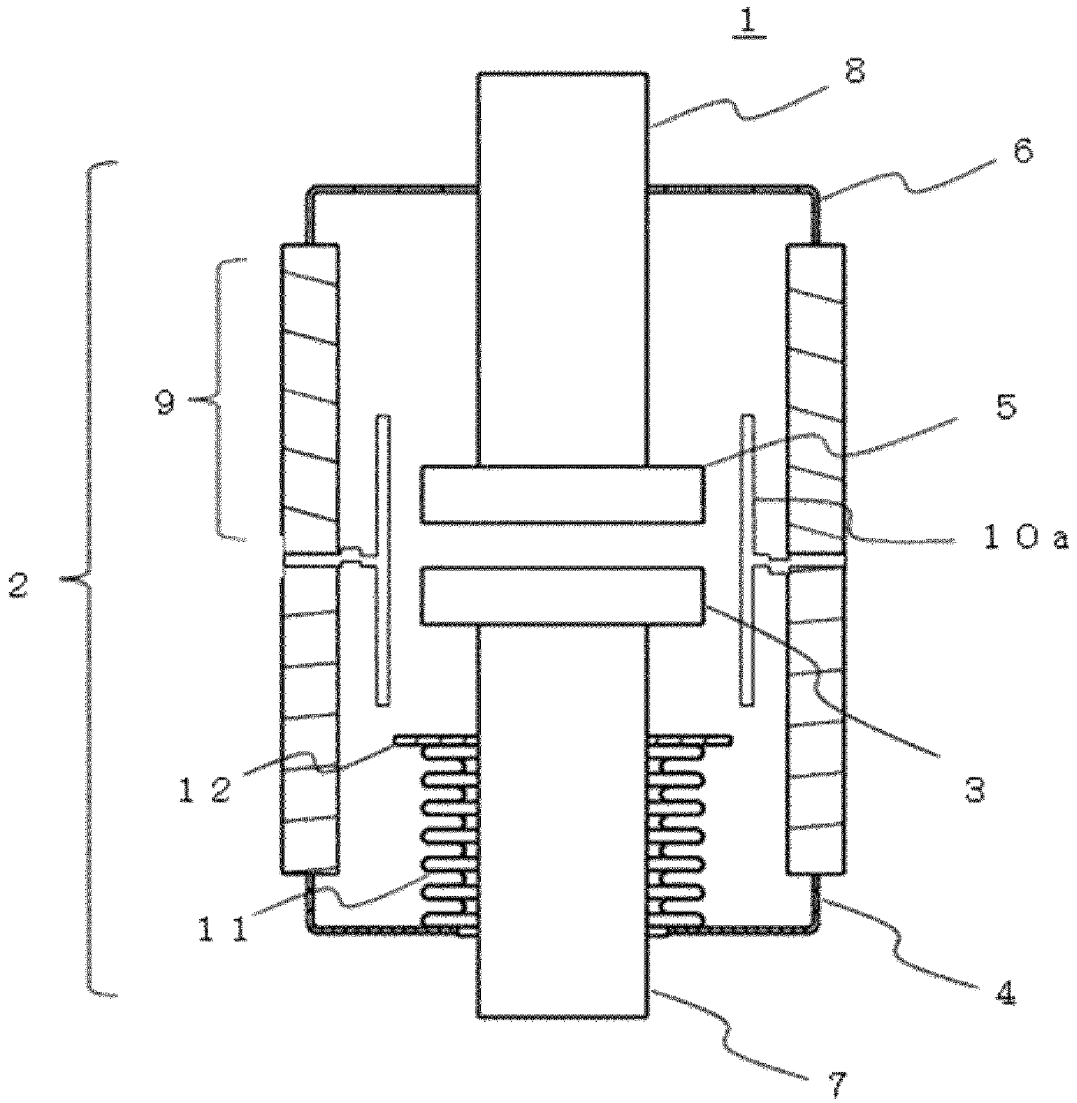
FIG. 9 is a sectional view of a vacuum interrupter according to embodiment 3 of the present invention.
Figure 10:
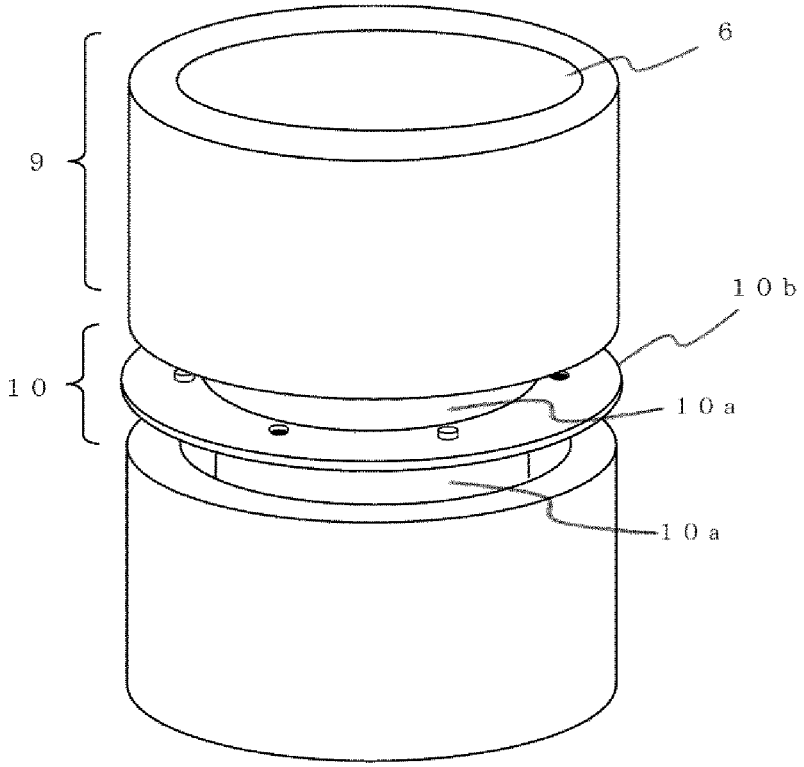
FIG. 10 is an assembly view of insulation containers and an arc shield according to embodiment 3 of the present invention.
Figure 11:
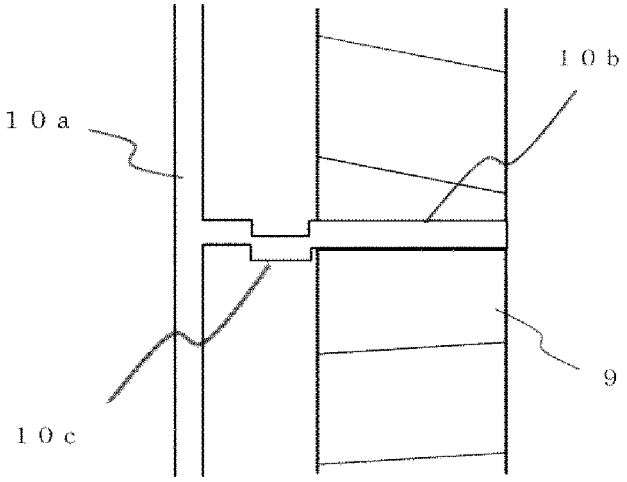
FIG. 11 is an enlarged sectional view of an embossed-shape projection of the arc shield according to embodiment 3 of the present invention.
Figure 12:
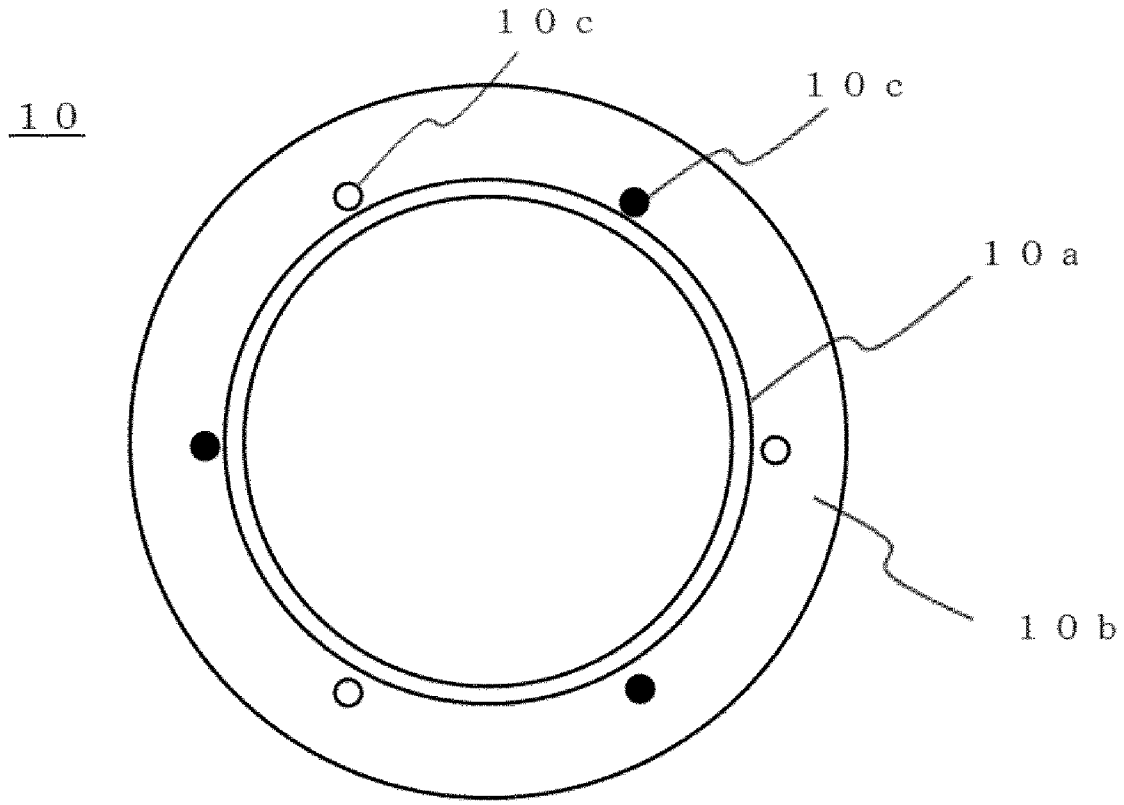
FIG. 12 is a plan view of the arc shield according to embodiment 3 of the present invention.

With reference to FIGS. 9 to 12, the structure of a vacuum interrupter according to the present embodiment will be described. FIG. 9 shows a sectional view of a vacuum interrupter 1 according to the present embodiment. FIG. 10 shows assembling of insulation containers 9 and an arc shield 10 of the vacuum interrupter 1 according to the present embodiment. In FIG. 10, a movable-side electrode rod 7 and a fixed-side electrode rod 8 are not shown, for simplification. FIG. 11 shows an enlarged sectional view of a flange portion 10*b* formed around the outer circumferential surface of a contamination preventing portion 10*a* of the arc shield 10, and an embossed-shape projection 10*c* formed on the flange portion 10*b*, and shows a state in which the projection 10*c* of the arc shield 10 is retained and fixed at the openings of the insulation containers 9. FIG. 12 shows a plan view of the arc shield 10, and shows the contamination preventing portion 10*a* of the arc shield 10, the flange portion 10*b* formed around the outer circumferential surface thereof, and the embossed-shape projections 10*c* formed on the flange portion 10*b*. It is noted that, in FIG. 12, the embossed-shape projections 10*c* are expressed as "○" and "•". The part "○" projects frontward of the drawing, and the part "•" projects backward of the drawing. In other words, these indicate projections upward/downward with respect to the flange portion 10*b*.

As shown in the sectional view of the vacuum interrupter 1 in FIG. 9, the assembly view in FIG. 10, and the like, the arc shield 10 has the disk-shaped flange portion 10*b* extending radially outward from the outer circumferential surface of the contamination preventing portion 10*a* surrounding the movable-side electrode 3 and the fixed-side electrode 5 opposed to each other. As shown in FIG. 10 and FIG. 11, the flange portion 10*b* is held between the opposed openings of the two insulation containers 9 and thus is fixed at a predetermined position of the vacuum container 2. As shown in the plan view of the arc shield 10 in FIG. 12, the flange portion 10*b* of the arc shield 10 has the embossed-shape projections 10*c* which project upward (shown by "○") or downward (shown by "•") with respect to the flange portion 10*b*, in the axial direction of the vacuum container.

The state in which the arc shield 10 is fixed by being held between the openings of the insulation containers 9 is shown in the enlarged sectional view in FIG. 11. The embossed-shape projections 10*c* which project upward/downward are formed on the flange portion 10*b* of the arc shield 10. The embossed-shape projections 10*c* are engaged with the openings of the insulation containers 9, thereby positioning and fixing the arc shield 10.

When the arc shield 10 is mounted such that the embossed-shape projections 10*c* formed on the flange portion 10*b* of the arc shield 10 are engaged with the inner circumferential portions of the openings of the insulation containers 9, the contamination preventing portion 10*a* of the arc shield 10 is located concentrically with the wall surface of the vacuum container 2, and thus the contamination preventing portion 10*a* can be prevented from becoming eccentric from the axis of the vacuum interrupter 1. As a result, there is no part where the distance between the contamination preventing portion 10*a* of the arc shield 10, and the movable-side electrode 3 and the fixed-side electrode 5, is shortened, and thus interruption performance and withstand voltage performance are stabilized.

Regarding positioning between the arc shield 10 and the inner circumferential portions of the insulation containers 9, the embossed-shape projections 10*c* formed on the flange portion 10*b* of the arc shield 10 have a positioning function. Therefore, an assembly jig for positioning is not needed and the working time can be shortened. Further, since the positioning is performed at the inner circumferential portions of the insulation containers 9, there are no protrusions on the outer circumferential portions of the insulation containers 9. Therefore, as compared to the case of embodiment 1 or embodiment 2, the insulation strength on the outer circumferential portions of the insulation containers 9 can be improved.

DESCRIPTION OF THE REFERENCE CHARACTERS

1 vacuum interrupter
2 vacuum container
3 movable-side electrode
4 movable-side end plate
5 fixed-side electrode
6 fixed-side end plate
7 movable-side electrode rod
8 fixed-side electrode rod
9 insulation container
10 arc shield
10*a* contamination preventing portion
10*b* flange portion
10*c* embossed-shape projection
10*d* protrusion piece
10*e* bent-shape projection
11 bellows
12 bellows cover

The invention claimed is:

1. A vacuum interrupter comprising:

a vacuum container formed by two insulation containers each having an opening at one end thereof, the openings being opposed to each other;

a pair of electrodes provided inside the vacuum container; and an arc shield having a contamination preventing portion surrounding the electrodes, a disk-shaped flange portion extending radially outward from an outer circumferential surface of the contamination preventing portion, and projections projecting in an axial direction of the vacuum container from the flange portion and having embossed shapes, the arc shield being positioned by the projections being engaged with the openings.

2. The vacuum interrupter according to claim 1, wherein the projections formed on the flange portion are obtained by forming projecting shapes on the flange portion.

3. The vacuum interrupter according to claim 1, wherein projecting directions of the projections formed on the flange portion are along an axial direction of the vacuum container, and include an upward direction and a downward direction with respect to a disk-shaped surface of the flange portion.

4. The vacuum interrupter according to claim 3, wherein the projecting directions of the projections formed on the flange portion are along the axial direction of the vacuum container, and the projections in the upward direction and the downward direction with respect to the disk-shaped surface of the flange portion are arranged alternately.

5. The vacuum interrupter according to claim 1, wherein the projections engaged with the openings so as to position the arc shield are formed on protrusion pieces protruding radially outward from the flange portion.

6. The vacuum interrupter according to claim 5, wherein the projections formed on the protrusion pieces are obtained by forming projecting shapes on the protrusion pieces.

7. The vacuum interrupter according to claim 5, wherein projecting directions of the projections formed on the protrusion pieces are along an axial direction of the vacuum container, and include an upward direction and a downward direction with respect to surfaces of the protrusion pieces.

8. The vacuum interrupter according to claim 7, wherein the projecting directions of the projections formed on the protrusion pieces are along the axial direction of the vacuum container, and the projections in the upward direction and the downward direction with respect to the surfaces of the protrusion pieces are arranged alternately.

9. The vacuum interrupter according to claim 1, wherein the arc shield is made from a conductive material, and the arc shield is configured to be able to be grounded.

10. The vacuum interrupter according to claim 1, wherein of the arc shield, a part protruding outside the vacuum container has a thin portion to be cut.

11. A vacuum circuit breaker comprising the vacuum interrupter according to claim 1.

12. A vacuum interrupter comprising:

a vacuum container formed by two insulation containers each having an opening at one end thereof, the openings being opposed to each other;

a pair of electrodes provided inside the vacuum container; and an arc shield having a contamination preventing portion surrounding the electrodes, a disk-shaped flange portion extending radially outward from an outer circumferential surface of the contamination preventing portion, and projections projecting in an axial direction of the vacuum container from the flange portion, the arc shield being positioned by the projections, wherein projecting directions of the projections are along an axial direction of the vacuum container, and include an upward direction and a downward direction with respect to a disk-shaped surface of the flange portion, and the projections are exteriorly positioned outside the vacuum container.

13. A vacuum circuit breaker comprising the vacuum interrupter according to claim 12.

* * * * *